United States Patent [19]

Williams

[11] Patent Number: 4,723,333

[45] Date of Patent: Feb. 9, 1988

[54] BRIDGING APPARATUS AND METHOD

[76] Inventor: A. Arthur Williams, 204 - 2780 Granville Street, Vancouver, British Columbia, Canada, V6H 3J3

[21] Appl. No.: 928,460

[22] Filed: Nov. 10, 1986

[51] Int. Cl.[4] ..... E01D 15/12

[52] U.S. Cl. ..... 14/2.4; 14/17; 52/227

[58] Field of Search ..... 14/1, 2.4, 17, 23, 73; 52/227, 747

[56] References Cited

U.S. PATENT DOCUMENTS

| | | | |
|---|---|---|---|
| 2,878,498 | 3/1959 | Gollnow | 14/1 |
| 3,066,771 | 12/1962 | Wolchuk | 14/73 X |
| 4,120,065 | 10/1978 | Sivachenko et al. | 14/17 X |
| 4,411,036 | 10/1983 | Fitzgerald-Smith | 14/2.4 |
| 4,520,523 | 6/1985 | Fitzgerald-Smith et al. | 14/2.4 |
| 4,521,932 | 6/1985 | Parramore | 14/2.4 |

FOREIGN PATENT DOCUMENTS

| | | | |
|---|---|---|---|
| 1938940 | 2/1971 | Fed. Rep. of Germany | 14/2.4 |
| 1266820 | 3/1972 | United Kingdom | 14/17 |

*Primary Examiner*—Stephen J. Novosad
*Assistant Examiner*—John F. Letchford
*Attorney, Agent, or Firm*—Bull, Housser & Tupper

[57] ABSTRACT

A bridge apparatus has a relatively light lower beam portion and a relatively heavy upper beam portion. The beam portions are generally equal in length. The lower beam portion is initially placed across the point to be bridged and has sufficient strength to support itself and to support the upper beam portion as the upper beam portion is moved across the lower beam portion. The upper beam portion is placed on top of the lower beam portion and fasteners are used for drawing together the two beam portions to close any gas therebetween and to rigidly connect the beam portions together so the beam portions jointly contribute to bearing the load.

16 Claims, 8 Drawing Figures

BRIDGING APPARATUS AND METHOD

FIELD OF THE INVENTION

This invention relates to a quick erection bridge and a method related thereto.

BACKGROUND OF THE INVENTION

Quick erection bridges are typically used for such purposes as forestry operations where temporary bridges are required. Forestry roads are frequently built only to provide temporary access during active logging operations. Once the logging operations are completed, the roads are often abandoned and bridges are removed. Thus it is highly desirable to provide bridges which may be quickly and economically erected and which can be dismantled and re-used at another point after logging operations are completed. Military operations as well require bridges which can be quickly erected with a minimum of equipment. Such bridges are also used for emergency purposes when permanent structures are washed out or collapse.

One problem associated with such quick erection bridges is the method of making the initial span across the creek, ravine or other gap to be crossed. It is possible to use cranes to position relatively heavy beams across the gap. However, this means that high load capacity cranes must be available and frequently this is not feasible or economical at remote sites. A common method used to make the initial span is to place a relatively lightweight "nose" at the leading edge of the bridge which is then moved across the distance to be spanned. The nose rests on a roller on the opposite side of the span and supports the permanent bridge structure as it is moved across the gap. The nose does not contribute to the permanent structure and is simply removed after the permanent structure spans the gap. The transport of the nose to the site and the assembly of the nose and disassembly of it are all tasks which increase the expense and time involved. U.S. Pat. No. 4,520,523 to Fitzgerald-Smith discloses a bridge module which is initially moved into place by means of a crane. Nose girders are connected to the front end of the bridge. The entire unit is then rolled over a roller beam, the nose girders being removed as they reach the far bank.

British Pat. No. 1,266,820 shows the use of rollers to reduce bending in the bottom chords of trusses while being launched.

Earlier U.S. patents of general interest include U.S. Pat. Nos. 3,491,391 to Soffge, 4,493,122 to Echtler, 4,120,065 to Sivachenko, 4,521,932 to Parramore, 3,707,011 to Launay, and 2,878,498 to Gollnow.

SUMMARY OF THE INVENTION

The invention provides a load bearing apparatus for spanning a distance between two ends thereof. The apparatus has a relatively light lower beam member having a length sufficient to span the distance and a relatively heavy upper beam member having a length generally equal to the length of the lower beam member. The upper beam member is positioned on the lower beam member. The lower beam member has sufficient strength to span the distance between the ends alone and to support the upper beam member when the upper beam member is moved across the lower beam member to span the distance. Fasteners draw together the upper beam member and the lower beam member to close any gap therebetween and to rigidly connect the upper beam member to the lower beam member along the lengths thereof so the upper beam member and the lower beam member jointly contribute to bearing the load.

The invention also provides a method of bridging a distance between two points. The method comprises the steps of providing a relatively light lower bridge portion and a relatively heavy upper bridge portion. The portions have generally a common length. The lower bridge portion is placed across the distance between the points. The upper bridge portion is then moved across the lower bridge portion so the upper bridge portion spans the distance above the lower beam portion. The upper bridge portion and the lower bridge portion are then drawn vertically together to close any gap therebetween due to differential deflection of the bridge portions. The bridge portions are connected together along the lengths thereof to form a unitary structure for supporting a load.

The method and apparatus according to the invention provide distinct advantages over the prior art. Firstly, the initial span can be made by a relatively light member which can be placed in position with a readily available low capacity crane. Furthermore, the member making the initial span is not discarded, but forms a unitary structure with the upper member to provide the necessary load carrying capacity. This reduces the amount of components that must be trucked to the site and avoids the cost and waste of time in using and spanning the distance with a member which will ultimately be discarded or returned for re-use elsewhere. Finally, the method and apparatus negate the need for expensive high capacity cranes to be on site. All work is performed by equipment more likely available, such as low capacity cranes.

DESCRIPTION OF THE PREFERRED EMBODIMENTS

Figure 1:
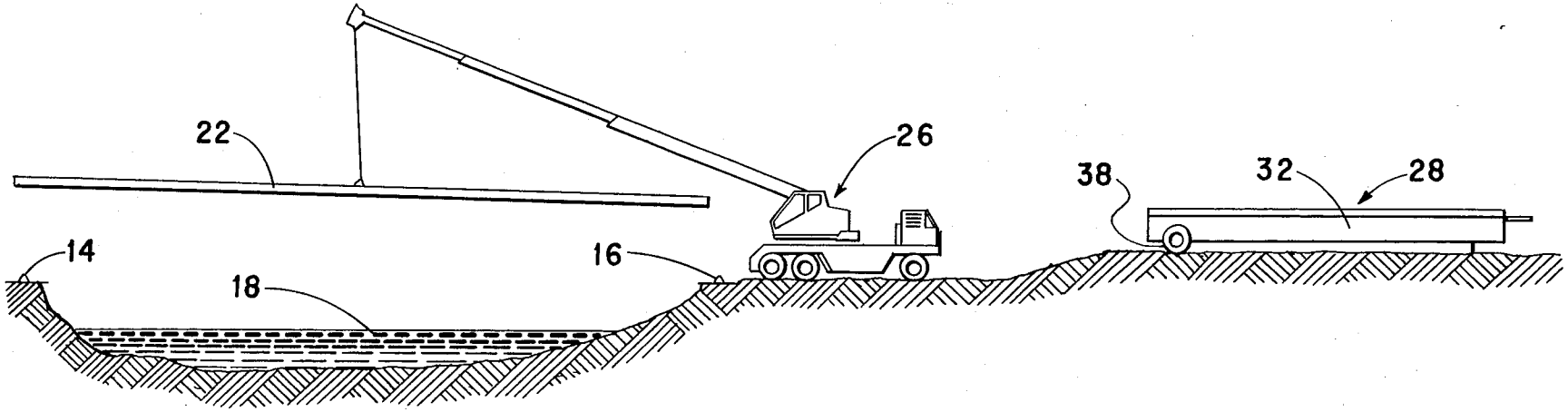
FIG. 1 is an elevation showing a crane positioning a lower beam member across a distance to be spanned.
Figure 2:
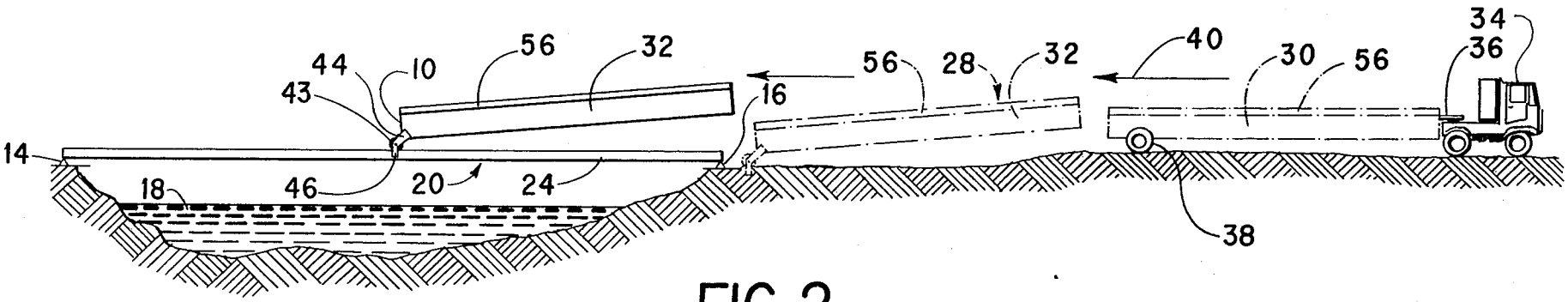
FIG. 2 is an elevational view showing the upper beam member being assembled, partly on the lower beam member.
Figure 3:
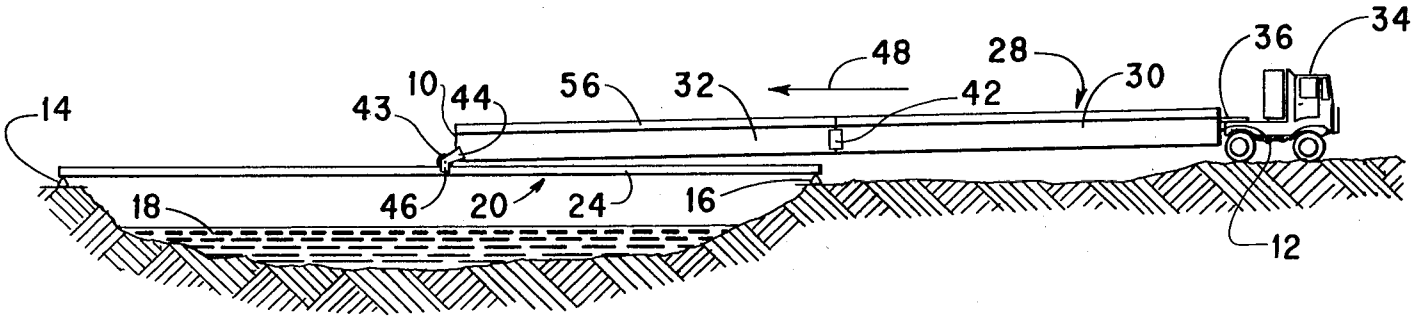
FIG. 3 is an elevational view showing the assembled upper beam member being moved across the lower beam member.
Figure 4:
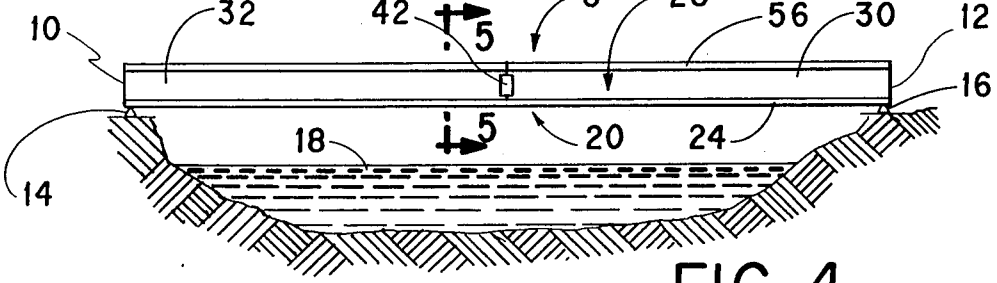
FIG. 4 is an elevational view showing the upper beam member resting on top of the lower beam member.
Figure 5:
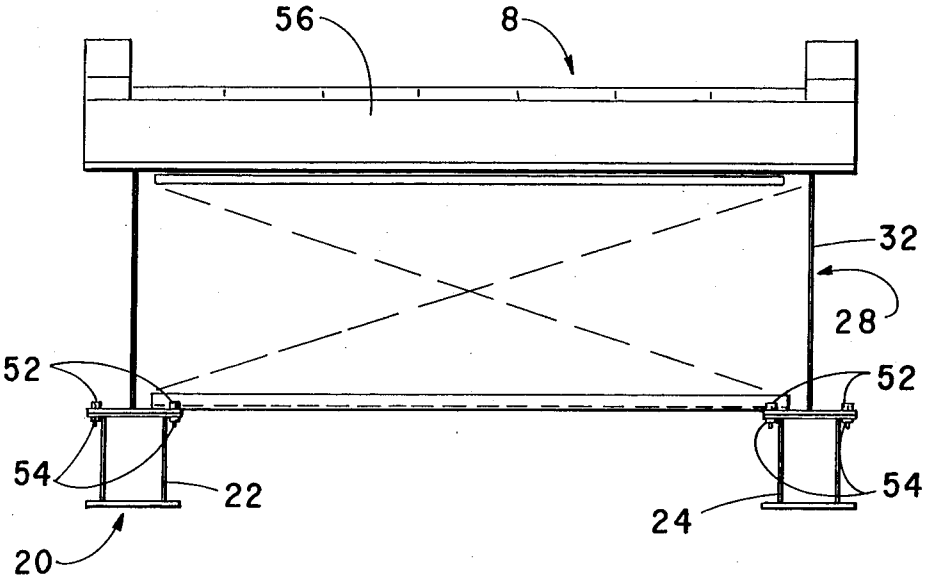
FIG. 5 is a sectional view along line 5—5 of FIG. 4.

The drawings show both a load bearing apparatus 8, shown assembled in FIGS. 4 and 5, and a method of bridging a distance between two points employing this apparatus, the steps being shown progressively in FIGS. 1–4.

The apparatus 8 has a length extending between its two ends 10 and 12, shown in FIG. 4, sufficient to span a distance between two points 14 and 16 representing bridge abutments. These points are typically on opposite sides of a depression such as creek 18 or other distance to be bridged. The apparatus has a relatively light lower beam portion 20 which, as may be seen in FIG. 5, comprises two separate and parallel box-section members 22 and 24 in this embodiment. In most instances the distance to be spanned between points 14 and 16 is too long for a single member. In such cases each of the members 22 and 24 is pre-assembled by laying identical members end to end and connecting them together by welding, bolting or riveting, or other suitable means. The members 22 and 24 are placed successively across the gap between points 14 and 16, normally employing a crane, such as crane 26 shown in FIG. 1. When positioned the members are parallel and both extend between points 14 and 16 as may be appreciated from FIGS. 1–5.

The apparatus 8 also includes a relatively heavy upper beam portion 28 which, in the preferred embodiment, is a prefabricated bridge unit employing steel beams in a braced structure as known in the prior art. The unit may be a plate girder as shown in FIG. 5 or a truss structure similar to the bridge structures used in earlier fast assembly bridges, such as those sold under the trade mark Bailey. Since the units are conventional, details of the girders or trusses are not provided other than to note that member 28 normally would be of a width suitable for highway transport and comprises one or more separate beam members, such as beam members 30 and 32 having a length suitable for highway transport. Before final assembly of the apparatus 8 the separate members 30 and 32 are abutted together and permanently connected by welding or bolting or the like as illustrated in FIGS. 2 and 3.

Although other means can be used, the illustrated embodiment incorporates one means for moving beam member 28 over beam portion 20 after the latter is in position. For this purpose a trailer hitch 36 is temporarily connected to one end of member 28. The opposite end is mounted on a dolly 38. The tractor 34 is used to move beam member 30 towards beam member 32 as shown in broken lines and illustrated by arrow 40. When members 30 and 32 are abutted together and in proper alignment they are connected together as mentioned by welding or bolting and using suitable reinforcement such as plate 42 shown in FIGS. 3 and 4.

Figure 7:
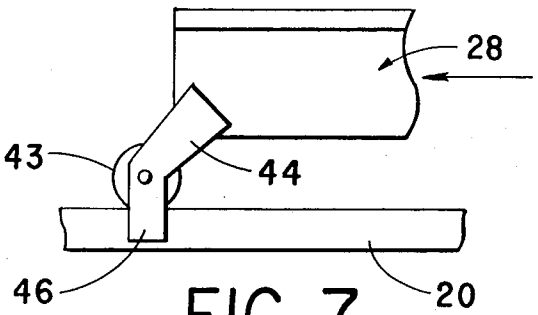
FIG. 7 is an enlarged, fragmentary elevation showing portions of the upper beam member and wheel and guide connected thereto.

In the preferred embodiment, as shown best in FIG. 7, a pair of wheels 43 are rotatably mounted on a pair of struts 44 (only one of each illustrated) temporarily connected to end 10 of beam portion 28 which is the end opposite trailer hitch 36. The wheels are spaced-apart such that one wheel is capable of riding on the top of box-section member 22, while the other wheel rides on top of member 24. Guides 46 extend downwardly from each of the struts below the tops of members 22 and 24 to guide the movement of upper beam portion 28 over lower beam portion 20. The guides prevent the wheels from rolling off the lower beam portion. As shown by arrow 48 in FIG. 3, the completed upper beam portion 28 is moved across the lower beam portion 20 until its ends 10 and 12 are above points 14 and 16 as shown in FIG. 4. It may be observed that the lower beam portion 20 and upper beam portion 28 have substantially the same length in this embodiment.

Figure 6:
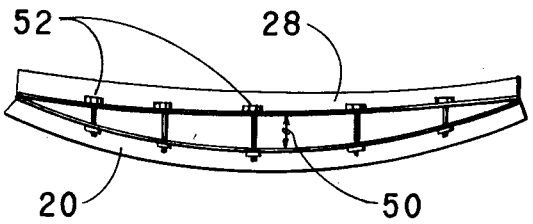
FIG. 6 is an enlarged, fragmentary elevation showing portions of the upper beam member and lower beam member and the fasteners used to close the gap therebetween.

Lower beam portion 20, comprising the two box-section members 22 and 24, has sufficient strength to support itself when spanning the distance between points 14 and 16 and to support upper beam portion 28 as it is moved across the lower beam portion as illustrated in FIGS. 2 and 3. Both beam portions 20 and 28 deflect downwardly under their own weight, but not the same amount due to the fact that upper beam portion 28 is deeper and structurally more rigid. The deflection by bending of the beam portions is illustrated in exaggerated form in FIG. 6. It may be seen that a gap 50 results due to the greater deflection of lower beam portion 20 when compared with upper beam portion 28. This gap is closed using a plurality of threaded fasteners which, in this embodiment are in the form of nut and bolt combinations 52 which extend through a plurality of spaced-apart apertures 54 extending along the bottom edges of upper beam portion 28 and the upper edges of members 22 and 24. Gap 50 is closed by gradually tightening the nut and bolt combinations to draw the members together and thus connecting them. Once the nut and bolt combinations are tight, lower beam portion 20 and upper beam portion 28 form a unitary structure for supporting a load. It is clear to someone skilled in the design of bridges or other such structures that apparatus 8 thus formed by the bolting together of lower beam portion 20 and upper beam portion 28 has a greater load carrying capacity than the sum of the load bearing capacities of the two portions. This is due to the increased depth of apparatus 8 when compared to either lower beam portion 20 or upper beam portion 28. Thus it may be seen that the total load bearing capacity is significantly increased by utilising the lower beam portion 20 and integrating it with the bridge structure comprising upper beam portion 28. The member initially making the span is not wasted and becomes an important part of the overall structure unlike prior art bridges of the general type.

Decking 56 is placed on and connected to the top of upper beam portion 28. This may be done after the upper beam portion and lower beam portion are connected together. However, preferably the decking is placed and connected to individual beam members 30 and 32 prior to transport of these members to the job site. This is illustrated in FIG. 2. The amount of work and assembly that must be done at the site of creek 18 or other bridge location is consequently minimized.

Figure 8:
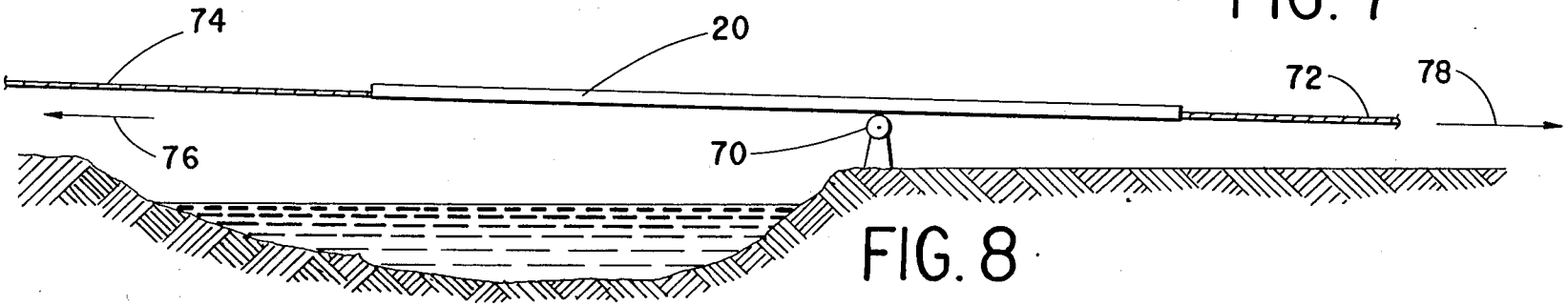
FIG. 8 is an elevational view showing an alternative method for moving the lower beam member across the distance to be spanned.

FIG. 8 shows an alternative method of moving the lower beam portion 20 across the ravine or such gap to be spanned. The beam portion 20 is supported on a roller 70. Cables 72 and 74 are connected to opposite ends of the beam portion. The beam portion is to be moved to the left from the side of the gap where the roller is positioned. This is accomplished by pulling on cable 74 with, for example, a tractor, a truck or a winch. A winch adjacent the roller may be used by looping the cable 74 about a pulley connected to a fixed object on the opposite side of the gap. Arrow 76 denotes the direction of the pulling force on cable 74 and the direction of movement of the beam portion. Back tension is maintained on cable 72 as indicated by arrow 78 to keep the beam portion 20 under control and to prevent it moving too far and falling, for example, into the ravine or creek.

What is claimed is:

1. A load bearing apparatus for spanning a distance between to ends thereof, the apparatus comprising:

(a) a relatively light lower beam member, having a length sufficient to span the distance and a relatively heavy upper beam member, having a length generally equal to the length of the lower beam member, and being positioned on the lower beam member, the lower beam member having sufficient strength to span the distance between the ends alone, and to support the upper beam member when the upper beam member is moved across the lower beam member to span said distance;

(b) fastening means for drawing together the upper beam member and the lower beam member to close any gap therebetween, and for rigidly connecting the upper beam member to the lower beam member along the lengths thereof, so the upper beam member and lower beam member jointly contribute to bearing the load; and (c) removable wheels on the upper beam member for supporting the upper beam member as the upper beam member is moved across the lower beam member to span said distance.

2. An apparatus as claimed in claim 1, wherein the lower beam member comprises a pair of laterally spaced-apart beams, each spanning the distance.

3. An apparatus as claimed in claim 1, wherein the upper beam member comprises one or more sections connected together end to end to provide said length.

4. An apparatus as claimed in claim 1, wherein the upper beam member comprises a bridge-like structure.

5. An apparatus as claimed in claim 1, further comprising decking on the upper beam member.

6. An apparatus as claimed in claim 1, further comprising guides at one end of the upper beam member to guide the upper beam member across the lower beam member.

7. A load bearing apparatus for spanning a distance between two ends thereof, the apparatus comprising:

(a) a relatively light lower beam member having a length sufficient to span the distance and a relatively heavy upper beam member, having a length generally equal to the length of the lower beam member, the lower beam member having sufficient strength to span the distance between the ends alone, and to support the upper beam member when the upper beam member is moved across the lower beam member to span said distance; and (b) fastening means for drawing together the upper beam member and the lower beam member to close any gap therebetween and for rigidly connecting the upper beam member to the lower beam member along the lengths thereof, so the upper beam member and lower beam member jointly contribute to bearing the load; and (c) a removable trailer hitch at a first end of the upper beam member for connecting the first end to a vehicle to move the upper beam member across the lower beam member, wheels at a second end of the upper beam member for supporting the upper beam member when moved across the lower beam member and guide means at the second end for guiding the upper beam member.

8. A method for bridging a distance between two points, comprising the steps of:

(a) providing a relatively light lower bridge portion and a relatively heavy upper bridge portion, said portions having a generally common length;

(b) placing the lower bridge portion across the distance between the points;

(c) temporarily connecting wheels to a first end of the upper bridge portion;

(d) temporarily connecting a trailer hitch to a second end of the upper bridge portion;

(e) connecting a vehicle to the trailer hitch;

(f) supporting the upper bridge portion with the lower bridge portion while moving the upper bridge portion with the vehicle across the lower bridge portion with the first end leading and into a position extending between the two points on top of the lower bridge portion; and (g) drawing the upper bridge portion and the lower bridge portion vertically together to close any gap therebetween due to differential deflection of the bridge portions, and connecting the bridge portions together along the lengths thereof, so the bridge portions form a unitary structure for supporting a load.

9. A method as claimed in claim 8, further comprising the step of providing corresponding spaced-apart apertures along the lengths of the upper and lower bridge portions, the bridge portions being drawn together by placing threaded fasteners through the corresponding apertures and tightening the threaded fasteners until the bridge portions are rigidly connected together and any said gap is closed.

10. A method as claimed in claim 8, wherein the lower bridge portion comprises a pair of members, the members being placed initially across the distance in laterally spaced-apart relationship and the upper bridge portion being wheeled across the members.

11. A method as claimed in claim 8, further comrising placing bridge decking on the upper bridge portion.

12. A method as claimed in claim 8, wherein the upper bridge portion has at least two sections, the method further comprising the step of connecting the sections together end to end before moving the upper bridge portion across the lower bridge portion.

13. A method as claimed in claim 8, wherein the lower bridge portion is placed across the distance with a crane.

14. A method as claimed in claim 8, wherein the lower bridge portion is placed across the distance by pulling one end with a cable.

15. A method as claimed in claim 14, wherein a back force is applied to an end of the lower bridge portion opposite the one end.

16. A method for bridging a distance between two points, comprising the steps of:

(a) providing a relatively light lower bridge portion and a relatively heavy upper bridge portion, said portions having a common length;

(b) rolling the lower bridge portion across the distance between the points on a roller while pulling one end with a cable;

(c) supporting the upper bridge portion with the lower bridge portion while moving the upper bridge portion into a position extending between the two points on top of the lower bridge portion; and (d) drawing the upper bridge portion and the lower bridge portion vertically together to close any gap therebetween due to differential deflection of the bridge portions, and connecting the bridge portions together along the lengths thereof, so the bridge portions form a unitary structure for supporting a load.

* * * * *